US007107732B2

(12) United States Patent
Kinzler

(10) Patent No.: US 7,107,732 B2
(45) Date of Patent: Sep. 19, 2006

(54) PURLIN CLIP FOR AN INSULATED CEILING OF A METAL BUILDING

(75) Inventor: Kevin W. Kinzler, Ames, IA (US)

(73) Assignee: High-R, Inc., Ames, IA (US), .

( * ) Notice: Subject to any disclaimer, the term of this patent is extended or adjusted under 35 U.S.C. 154(b) by 122 days.

(21) Appl. No.: 10/671,369

(22) Filed: Sep. 25, 2003

(65) Prior Publication Data

US 2005/0066604 A1 Mar. 31, 2005

(51) Int. Cl.
*E04B 1/74* (2006.01)

(52) U.S. Cl. ..... 52/404.5; 52/409; 52/410; 52/404.3; 52/478; 52/543; 52/506.05

(58) Field of Classification Search ..... 52/748.1, 52/521, 548, 537, 543, 404.1, 404.3, 404.5, 52/408–410, 506.05, 478
See application file for complete search history.

(56) References Cited

U.S. PATENT DOCUMENTS 3,536,281 A * 10/1970 Attore et al. ..... 248/73
3,720,395 A * 3/1973 Schuplin ..... 248/228.7
4,133,161 A * 1/1979 Lester ..... 52/748.1
4,362,284 A * 12/1982 Bolante ..... 248/228.7
4,575,983 A * 3/1986 Lott et al. ..... 52/544
4,724,651 A 2/1988 Fligg
4,930,285 A * 6/1990 Ward ..... 52/742.12
5,085,023 A * 2/1992 Duffy ..... 52/410
5,245,811 A 9/1993 Knorr
5,636,487 A * 6/1997 Fligg ..... 52/404.5
5,692,352 A * 12/1997 Simpson ..... 52/545
5,737,894 A * 4/1998 Simpson et al. ..... 52/520
5,842,316 A * 12/1998 Keiper ..... 52/410
5,934,019 A * 8/1999 Rotharmel et al. ..... 49/28
6,086,032 A 7/2000 van Leeuwen
6,330,779 B1 12/2001 Kinzler
6,889,478 B1 * 5/2005 Simpson ..... 52/520

* cited by examiner

*Primary Examiner*—Carl D. Friedman
*Assistant Examiner*—Yvonne M. Horton
(74) *Attorney, Agent, or Firm*—McKee, Voorhees & Sease, P.L.C.

(57) ABSTRACT

An insulated ceiling is provided for a metal building, an includes a plurality of spaced apart metal purlins with upper and lower flanges, a metal roof attached to the upper flanges of the purlins, insulated panels attached to the bottom flanges of the purlins so as to define a space between the roof and the panels, and insulation in the space. The panels are mechanically attached to the purlins with a plurality of clips and support members such that penetrating fasteners are unnecessary.

12 Claims, 3 Drawing Sheets

PURLIN CLIP FOR AN INSULATED CEILING OF A METAL BUILDING

BACKGROUND OF THE INVENTION

Metal buildings are popular due to the relatively quick construction and low cost, as well as low maintenance. However, metal components of these buildings have high thermal conductivity, and thus it is difficult to efficiently and effectively control temperatures within such metal buildings. Heating and cooling costs can be relatively high.

Conventional ceiling insulation in metal buildings involves placing a layer of insulating material over the top of the roof purlins, with the roof deck then being attached over the insulation to the purlins. The roof deck squeezes the insulation above each purlin thereby reducing the R-value and increasing energy loss. The insulation is installed from the outside of the building, and involves relatively costly labor which can also be dangerous and difficult in windy or wet conditions.

Applicant's patent U.S. Pat. No. 6,330,779 overcame many of the problems associated with conventional insulated ceilings for metal buildings by attaching a substantially rigid insulated sheet to the bottom flange of the purlins and then filling the space between the insulation board and the roofing deck with insulation. However, the insulation board was attached to the purlins using penetrating fasteners, such as self tapping screws. This method of attaching the insulation board to the purlin is time consuming and therefore costly. Also, the metal screws provide thermal conductivity through the metal purlins and metal roof decking, thereby reducing the R-value and increasing energy costs.

Therefore, a primary objective of the present invention is the provision of an improved insulated ceiling for a metal building with minimized thermal conductivity.

Another objective of the present invention is the provision of a purlin clip for quickly and easily attaching insulation board to purlins in a metal roof structure.

Another objective of the present invention is the provision of an insulated ceiling in a metal roof which attaches insulation board to the metal purlins without the use of penetrating fasteners.

A further objective of the present invention is the provision of a method of building an insulated ceiling which is inexpensive yet energy efficient.

A further objective of the present invention is the provision of a method of insulating a metal roof inside of the building after the roof deck has been installed.

These and other objectives will become apparent from the following description of the invention.

SUMMARY OF THE INVENTION

The insulated ceiling of the present invention includes a plurality of spaced apart metal purlins having upper and lower flanges. A metal roof is attached to the upper flanges of the purlins and insulated panels are attached to the lower flanges of the purlins. The insulation panels and the roof define a space therebetween to which additional insulation can be installed by blowing or other conventional means. The insulation panels are mechanically attached to the lower flange of the purlins without the use of penetrating fasteners. The attachment of the panels to the purlins is accomplished with a plurality of clips which have an upper channel which quickly and easily clips or snaps onto the lower flange of the purlins without the use of tools. The clips have a lower channel which slidably receives a panel support member.

The panel support members engage and support the edges of the insulation boards, thereby attaching the boards to the purlins.

The method of building the insulated ceiling according to the present invention includes the steps of supporting purlins in a spaced apart orientation, attaching a metal roof to the upper flange of the purlins, and attaching the insulated ceiling panels to the lower flange of the purlins without the use of penetrating fasteners. Purlin clips allow for a quick and easy installation of the ceiling panels onto the purlins. Additional insulation can then be installed in the space between the roof and the ceiling panels.

DETAILED DESCRIPTION OF THE PREFERRED EMBODIMENT

Figure 1:
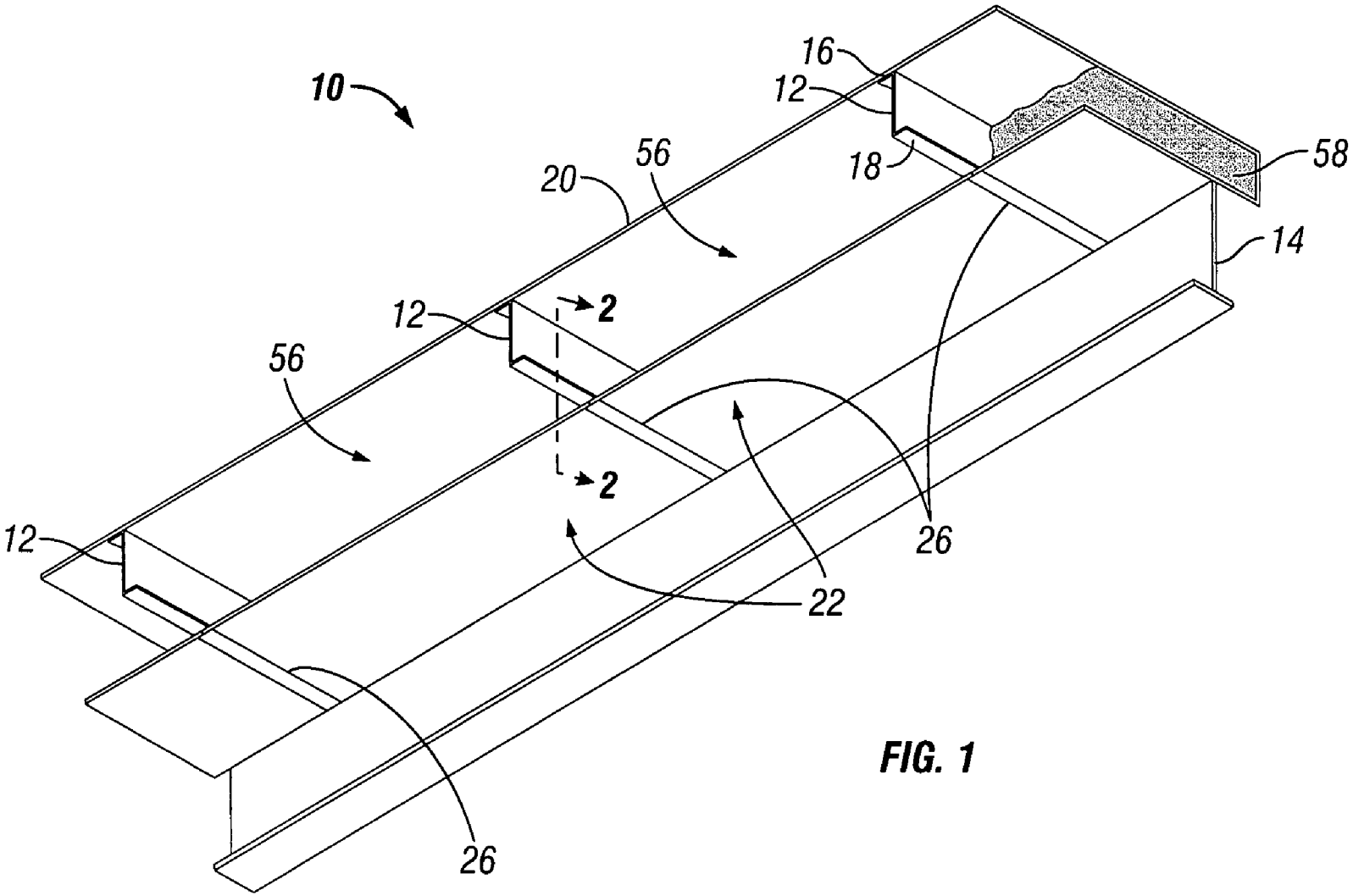
FIG. 1 is a perspective view of the insulated ceiling of the present invention.

Reference numeral 10 generally designates the improved insulated ceiling or metal building according to the present invention. The ceiling 10 includes a plurality of spaced apart secondary framing members 12, commonly known as purlins, supported on I-beams or other structural framing 14. The purlins 12 are spaced apart and parallel to one another and generally have a Z-profile, as seen in FIG. 1, or a C-profile. Each purlin 12 includes an upper flange 16 and a lower flange 18. A roof deck 20 is attached to the upper flange 16 of the purlins 12 using conventional fasteners (not shown). The deck 20 may be flat or corrugated metal. The purlins 12, I-beams 14, and roof deck 20 are conventionally constructed.

Insulated ceiling panels 22 are attached to a lower flange 18 of the purlins 12 without the use of penetrating fasteners, such as screws or bolts. Rather, the ceiling panels 22 are attached to the purlins 12 with a plurality of purlin clips 24 and support members 26.

Figure 2:
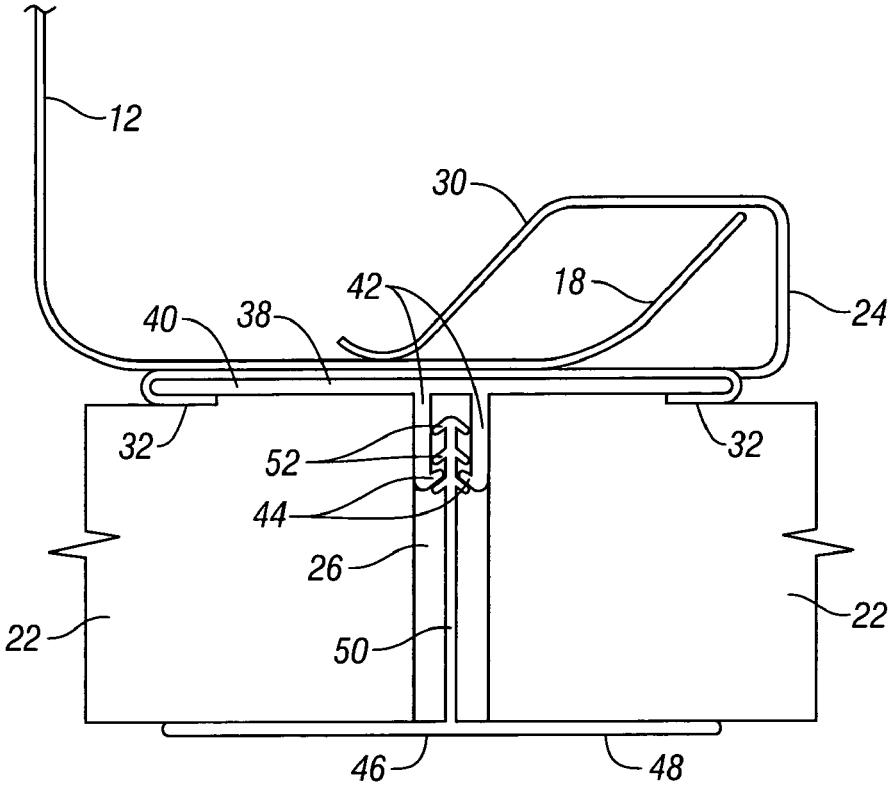
FIG. 2 is an enlarged side elevation sectional view taken along lines 2—2 of FIG. 1.
Figure 3:
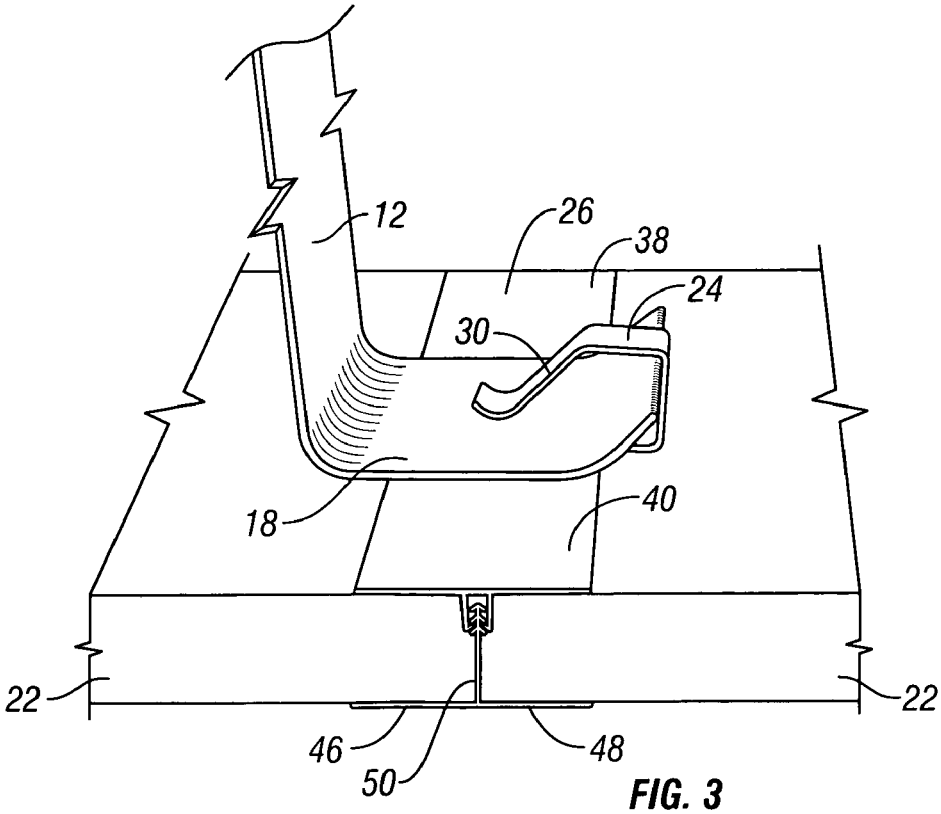
FIG. 3 is an upper perspective view of a section of the ceiling of the present invention.
Figure 4:
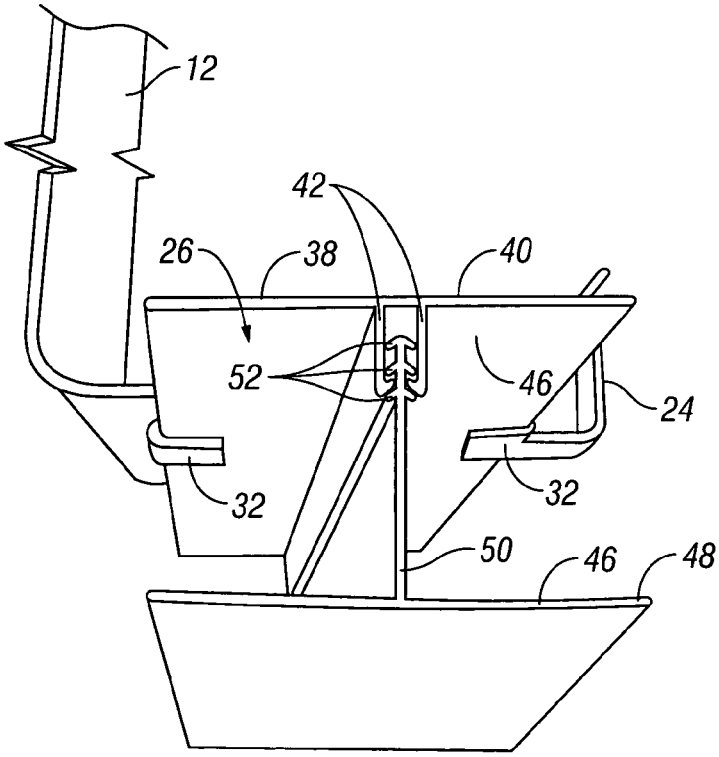
FIG. 4 is a lower perspective view of a portion of the insulated ceiling of the present invention, without the insulation board.
Figure 5:
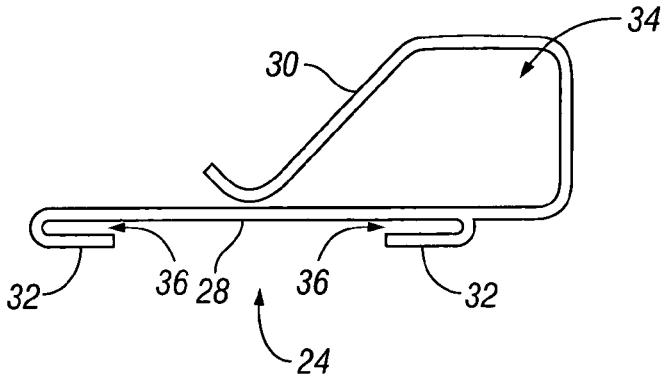
FIG. 5 is a side elevation view of the purlin clip of the present invention.
Figure 6:
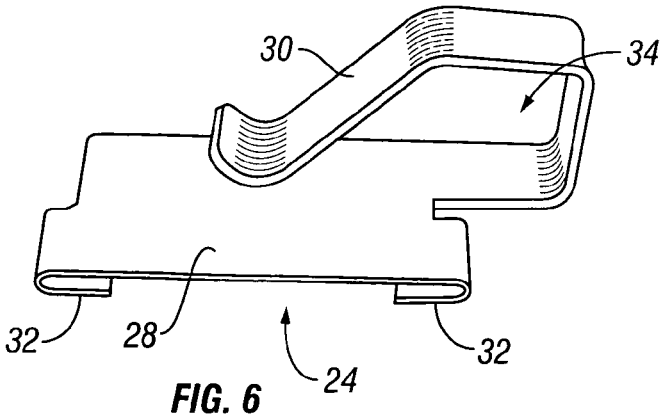
FIG. 6 is a perspective view of the purlin clip of the present invention.

FIGS. 5 and 6 show one of the purlin clips 24. Each clip 24 includes a body 28 within an upper arm 30 and a pair of lower legs 32. The body 28 and upper arm 30 define an upper channel 34 which is adapted to receive the lower flange 18 of the purlin 12, as seen in FIGS. 2 and 3. The body 28 and lower legs 32 define a lower channel 36 which is adapted to slidably receive the support members 26, as seen in FIGS. 2 and 4. In FIG. 6, the arm 30 of the clip 24 is laterally offset with respect to the legs 32 of the clip 24. The arm 30 is resilient so that the lower flange 18 of the purlin 12 can be easily inserted into the upper channel 34 of the clips 24. Preferably, the clip 24 has a one-piece construction, with the arm 30 and legs 32 being formed from a single piece of metal. Alternatively, the clip 24 may be made from more than one piece.

Each support member 26 includes a female portion 38 which has an upper cross member 40 and a pair of downwardly extending legs 42 which terminate in inwardly and upwardly turned edges 44. Each support member 26 also includes a lower male portion 46 having a lower cross member 48 and an upstanding leg 50 terminating in outwardly and downwardly extending ribs 52. The spaced apart legs 42 of the female portion 38 define a channel which is adapted to receive a leg 50 of the male portion 46, with the ribs 52 being retained by the upturned ends 44 of the legs 42.

Preferably, the female portion 38 and male portion 46 of the support members 26 are made from plastic so as to have low thermal conductivity. The ribs 52 of the male portion are adapted to slide longitudinally along the channel formed by the legs 42 of the female portion 38. The assembled male and female portions form laterally open channels or slots 54 which are adapted to receive the edges of the ceiling panels 22, as seen in FIGS. 2 and 3. The upper cross member 40 of the female portion 38 is adapted to slide longitudinally through the lower channel 36 of the clip 24. Thus, the clips 24 and the support members 26 attach the ceiling panels 22 to the purlins 12 without penetrating fasteners, without the use of adhesive or other bonding materials, and without tools.

In constructing the insulated ceiling 10 of the present invention, the purlins 12 are supported and attached to the beams 14 in spaced apart, parallel orientation. The roof deck 20 is then attached to the upper flange 16 of the purlins 12 using conventional fasteners. The purlin clips 24 are mounted on the lower flanges 18 of the purlins 12. The female 38 and male portion 46 of the support members 26 are assembled, and the support members 26 may be slidingly received in the lower channels 26 of the clips either before or after the clips are mounted on the purlins 12. The ceiling panels 22 are then installed in the panels 54 of the support members 26, so as to be effectively secured to the purlins 12. The lower cross member 48 of the male portion 46 of the support members 26 forms a trim piece which covers the mating edges of adjacent ceiling panels 22. The ceiling panels 22 and roof deck 20 define a space or gap 56 therebetween into which additional insulation 58 may be blown or installed.

Thus, the insulated ceiling and the method of building the insulated ceiling, including the purlin clips, accomplishes at least all of the stated objectives.

The preferred embodiment of the present invention has been set forth in the drawings, specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. An insulated ceiling for a building, comprising:

a plurality of spaced apart metal purlins having upper and lower flanges;

a metal roof attached to the upper flanges of the purlins;

a panel attached to the bottom flanges of the purlins so as to define a space between the metal roof and the panel;

insulation in the space;

the panel being mechanically attached to the purlins without the use of penetrating fasteners;

a plurality of clips clipped onto the lower flanges of the purlins; and a panel support member attached to the clips to support the panel.

2. The insulated ceiling of claim 1 wherein the clips each have an upper channel mounted on the lower flange of the purlin and a lower channel in which the panel support member is mounted.

3. The insulated ceiling of claim 2 wherein the panel support member is slidably received in the lower channel of the clip.

4. The insulated ceiling of claim 1 wherein the clips each have an upper channel mounted on the lower flange of the purlin and a lower channel in which the panel support member is mounted.

5. A method of building an insulated ceiling, comprising:

supporting purlins in a spaced apart orientation, each purlin having upper and lower flanges;

attaching a metal roof to the upper flange of the purlins;

attaching a ceiling panel to the lower flange of the purlins without the use of penetrating fasteners so as to define a space between the roof and the ceiling panel;

adding insulation in the space; and clipping the ceiling panel to the purlins.

6. The method of claim 5 further comprising attaching a panel support member to each purlin to support the panel between adjacent purlins.

7. The method of claim 5 further comprising supporting opposite edges of each panel with a support member attached to the lower flange of the purlins.

8. The method of claim 7 further comprising clipping the support member to the lower flange of the purlins.

9. A method of building an insulated ceiling, comprising:

supporting purlins in a spaced apart orientation, each purlin having upper and lower flanges;

attaching a metal roof to the upper flange of the purlins;

attaching a ceiling panel to the lower flange of the purlins without the use of penetrating fasteners so as to define a space between the roof and the ceiling panel;

adding insulation in the space; and supporting opposite edges of the panel with a support member attached to the lower flange of the purlins.

10. The method of claim 9 wherein the ceiling panel is clipped to the purlins.

11. The method of claim 9 further comprising attaching a panel support member to each purlin to support the panel between adjacent purlins.

12. The method of claim 9 further comprising clipping the support member to the lower flange of the purlins.

* * * * *